US007770571B2

(12) United States Patent
Tippmann, Jr. et al.

(10) Patent No.: US 7,770,571 B2
(45) Date of Patent: Aug. 10, 2010

(54) ANTI-JAM MECHANISM

(75) Inventors: Dennis J. Tippmann, Jr., Fort Wayne, IN (US); Jeffrey P. Douglas, Fort Wayne, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 1221 days.

(21) Appl. No.: 11/348,951

(22) Filed: Feb. 7, 2006

(65) Prior Publication Data

US 2007/0181117 A1 Aug. 9, 2007

(51) Int. Cl.
*F41B 11/00* (2006.01)

(52) U.S. Cl. ..... 124/73; 124/76

(58) Field of Classification Search ..... 124/72–77; 42/69.02

See application file for complete search history.

(56) References Cited

U.S. PATENT DOCUMENTS

| | | | | |
|---|---|---|---|---|
| 5,349,938 | A * | 9/1994 | Farrell | 124/73 |
| 5,542,406 | A * | 8/1996 | Oneto | 124/73 |
| 5,634,456 | A * | 6/1997 | Perrone | 124/76 |
| 6,212,991 | B1 * | 4/2001 | Frazier, III | 89/196 |
| 6,233,928 | B1 * | 5/2001 | Scott | 60/407 |
| 6,553,983 | B1 | 4/2003 | Li | |
| 6,557,542 | B1 | 5/2003 | Orr | |
| 6,820,606 | B1 | 11/2004 | Duffey | |
| 7,121,271 | B1 | 10/2006 | Arndt | |
| 7,451,756 | B2 * | 11/2008 | Tippmann, Jr. | 124/81 |
| 2002/0170551 | A1 | 11/2002 | Kotsiopoulos et al. | |
| 2003/0047175 | A1 | 3/2003 | Farrell | |
| 2003/0168053 | A1 * | 9/2003 | Farrell | 124/76 |
| 2003/0226555 | A1 * | 12/2003 | Reible | 124/73 |
| 2004/0144377 | A1 | 7/2004 | Dobbins | |
| 2004/0237954 | A1 | 12/2004 | Styles et al. | |
| 2005/0028802 | A1 | 2/2005 | Jones | |
| 2005/0109329 | A1 | 5/2005 | Janavicius | |
| 2006/0027221 | A1 * | 2/2006 | Farrell | 124/31 |
| 2007/0163563 | A1 * | 7/2007 | Gan | 124/73 |
| 2008/0078971 | A1 * | 4/2008 | Quinn et al. | 251/205 |

OTHER PUBLICATIONS

Portions of web site located at: http://www.apbbolts.com.

* cited by examiner

*Primary Examiner*—Troy Chambers
*Assistant Examiner*—Gabriel J Klein
(74) *Attorney, Agent, or Firm*—Barnes & Thornburg LLP

(57) ABSTRACT

An anti-jam firing mechanism comprises a front bolt movable between a first position and a second position, in which a crossover point is positioned between the first position and the second position. The front bolt is operative to engage a frangible projectile, such as a paintball, as the front bolt moves from the first position to the second position. A drive mechanism drives the front bolt with either a first force or a second force. The drive mechanism drives the front bolt with the first force when the front bolt travels between the first position and the crossover point. When the front bolt travels between the crossover point and the second position, the drive mechanism drives the front bolt with the second force. Typically, the first force is less than a projectile rupturing force.

59 Claims, 4 Drawing Sheets

ANTI-JAM MECHANISM

TECHNICAL FIELD

This invention relates to firing mechanisms for propelling frangible projectiles, such as paintballs, and particularly to a firing mechanism that prevents rupturing of the frangible projectiles during firing.

BACKGROUND

Devices that fire frangible projectiles are known in the art. For example, marking guns (commonly known as paintball guns) typically use compressed gas to propel frangible projectiles. The frangible projectiles commonly have a gelatinous or plastic shell designed to break upon impact. Typically, the shells are filled with a marking material, such as paint, and/or an immobilizing material, such as a noxious chemical.

These types of devices have a wide variety of applications. For example, a popular recreational use is in paintball games, in which opposing sides attempt to seek out and "shoot" one another with paintballs. Frangible projectiles have also been used to segregate cattle within a herd. Likewise, law enforcement personnel employ frangible projectiles with immobilizing materials for crowd control.

The fragile nature of the projectiles often creates difficulties in reliably firing the device. Typically, the firing mechanism includes a bolt that pushes a frangible projectile into a barrel of the device when the user pulls the trigger. In some cases, however, the projectiles may become partially inserted into the breech. When this happens, the bolt tends to shear or rupture the projectile, which fouls the breech and barrel of the weapon.

Electrical and mechanical systems have been proposed to solve this problem. For example, some devices employ optical sensors to sense the presence of a projectile in the breech of the marker. These systems seek to prevent accidental rupturing by preventing firing when the projectile is not wholly within the device's breech. If a rupture occurs in the breech, however, the optics of such systems can become fouled, typically rendering the system unreliable or possibly even inoperable. Spring-loaded bolts have also been proposed to prevent accidental rupturing of projectiles during firing. In these devices, the spring drives the bolt with less force than that required to rupture a projectile. However, the spring's weak force is typically insufficient to withstand pressure exerted on the bolt during firing. This tends to move the bolt rearward to a position where gas may flow into the projectile feed port, which interferes with loading of the weapon.

Therefore, there exists a need for a firing mechanism that operates in a reliable manner, while preventing the rupturing of projectiles during firing.

SUMMARY

An anti-jam firing mechanism in accordance with one aspect of the invention comprises a front bolt that may be moved between a first position and a second position. The firing mechanism includes a first drive mechanism that is operative to drive the front bolt toward the second position. A linkage arm is operatively connected to the front bolt and capable of engaging a second drive mechanism. When engaged by the linkage arm, the second drive mechanism drives the front bolt toward the second position. The linkage arm engages the second drive mechanism when the front bolt travels a predetermined distance from the first position to the second position.

In some exemplary embodiments, the first drive mechanism drives the front bolt with a different force than the second drive mechanism. For example, the first drive mechanism may drive the front bolt with less force than the second drive mechanism. Typically, the first drive mechanism will drive the front bolt with less than a projectile rupturing force. By "projectile rupturing force," it is meant a force that is less than that required to rupture or shear a frangible projectile. In such cases, the front bolt will not rupture a projectile when independently driven by the first drive mechanism. Often, the first drive mechanism and the second drive mechanism will include at least one compression spring. In some cases, the firing mechanism may be constructed such that the first bolt and the second drive mechanism move along a common axis.

The firing mechanism may be constructed such that the second drive mechanism includes a recess dimensioned to receive a portion of the linkage arm. For example, the linkage arm may include a tip portion capable of engaging the recess. In this regard, the tip portion may engage the recess when the front bolt travels a predetermined distance from the first position to the second position.

Depending on the exigencies of a particular application, the firing mechanism may include a guide operative to control lateral movement of the linkage arm's tip portion. For example, the guide may be constructed such that a portion of the linkage arm passes through the guide. In some embodiments, the linkage arm may include a curved portion that engages the guide. Typically, the curved portion is located between the first end and the second end of the front bolt's travel.

According to another aspect, the invention provides a firing mechanism comprising a front bolt that may engage a frangible projectile when moving between a first position and a second position. The firing mechanism may include a first drive means for driving the front bolt toward said second position. A second drive means may be provided for driving the front bolt toward the second position after the front bolt travels a predetermined distance from the first position to the second position.

In some exemplary embodiments, the first drive means drives the front bolt with a different force than the second drive means. For example, the first drive means may drive the front bolt with less force than the second drive means. In some such embodiments, the first drive means may drive the front bolt with a force less than a projectile rupturing force.

The invention also provides a projectile launcher with an anti-jam firing mechanism. The launcher comprises a barrel dimensioned to receive a frangible projectile. A breech is proximate to the barrel and also dimensioned to receive the frangible projectile. A valve assembly operates to selectively allow flow between a supply of compressed gas and the breech. A front bolt may move between a first position and a second position such that the front bolt pushes the frangible projectile out of the breech as the front bolt moves from the first position to the second position. A first drive mechanism operates to drive the front bolt toward the second position. A rear bolt may move between a third position and a fourth position such that the rear bolt actuates the valve assembly when the rear bolt moves to the fourth position. A drive spring may be provided to urge the rear bolt to the fourth position. A linkage arm may be operatively connected to the front bolt and capable of engaging the rear bolt. The drive spring may urge the front bolt toward the second position when the linkage arm engages the rear bolt. The linkage arm may engage the rear bolt when the front bolt travels a predetermined distance from the first position to the second position.

In some examples, the front bolt may move concomitant with the rear bolt when the linkage arm engages the rear bolt. The linkage arm may also move concomitant with the front bolt. The first drive mechanism may be constructed to drive the front bolt with less force than the drive spring. Typically, the first drive mechanism drives the front bolt with less than a projectile rupturing force.

The rear bolt may be constructed with a recess dimensioned to receive a portion of the linkage arm. For example, the linkage arm may include a tip portion capable of engaging the recess. In some cases, the tip portion may engage the recess when the front bolt travels a predetermined distance from the first position to the second position.

In some exemplary embodiments, the gun may include a guide operative to control lateral movement of the linkage arm's tip portion. For example, a portion of the linkage arm may pass through the guide. In some embodiments, the linkage arm may include a curved portion that engages the guide. In some such embodiments, the curved portion may be located between the first end and the second end of the front bolt's travel.

According to a further aspect, the invention provides a method of expelling a projectile from a breech of a launcher. The method includes the step of releasing a first drive mechanism and a second drive mechanism responsive to actuation of a trigger. The first drive mechanism drives a front bolt, such that the front bolt pushes a projectile out of a breech when the front bolt moves from a first position to a second position. If the front bolt travels a predetermined distance from the first position to the second position, the second drive mechanism drives the front bolt. The first drive mechanism preferably drives the front bolt with a force less than a projectile rupturing force.

A still further aspect of the present invention is achieved by a paintball gun with an anti-jam firing mechanism. The paintball gun has a barrel and breech that are dimensioned to receive a paintball. A firing mechanism is provided with a front bolt that may move between a first position and a second position. The front bolt is operative to push the paintball out of the breech as the front bolt moves from the first position to the second position. A drive mechanism is also provided that may drive the front bolt with either a first force or a second force. The drive mechanism drives the front bolt with the first force which is less than a projectile rupturing force, when the front bolt travels between the first position and the crossover point. The drive mechanism drives the front bolt with the second force when the front bolt travels between the crossover point and the second position.

Another aspect of the present invention is achieved by an anti-jam firing mechanism comprising a front bolt movable between a first position and a second position, in which a crossover point is positioned between the first position and the second position. The front bolt is operative to engage a frangible projectile, such as a paintball, as the front bolt moves from the first position to the second position. A drive mechanism drives the front bolt with either a first force or a second force. The drive mechanism drives the front bolt with the first force when the front bolt travels between the first position and the crossover point. When the front bolt travels between the crossover point and the second position, the drive mechanism drives the front bolt with the second force. Typically, the first force is less than a projectile rupturing force.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF DRAWINGS

The present disclosure will be described hereafter with reference to the attached drawings which are given as non-limiting examples only, in which.

Figure 1:
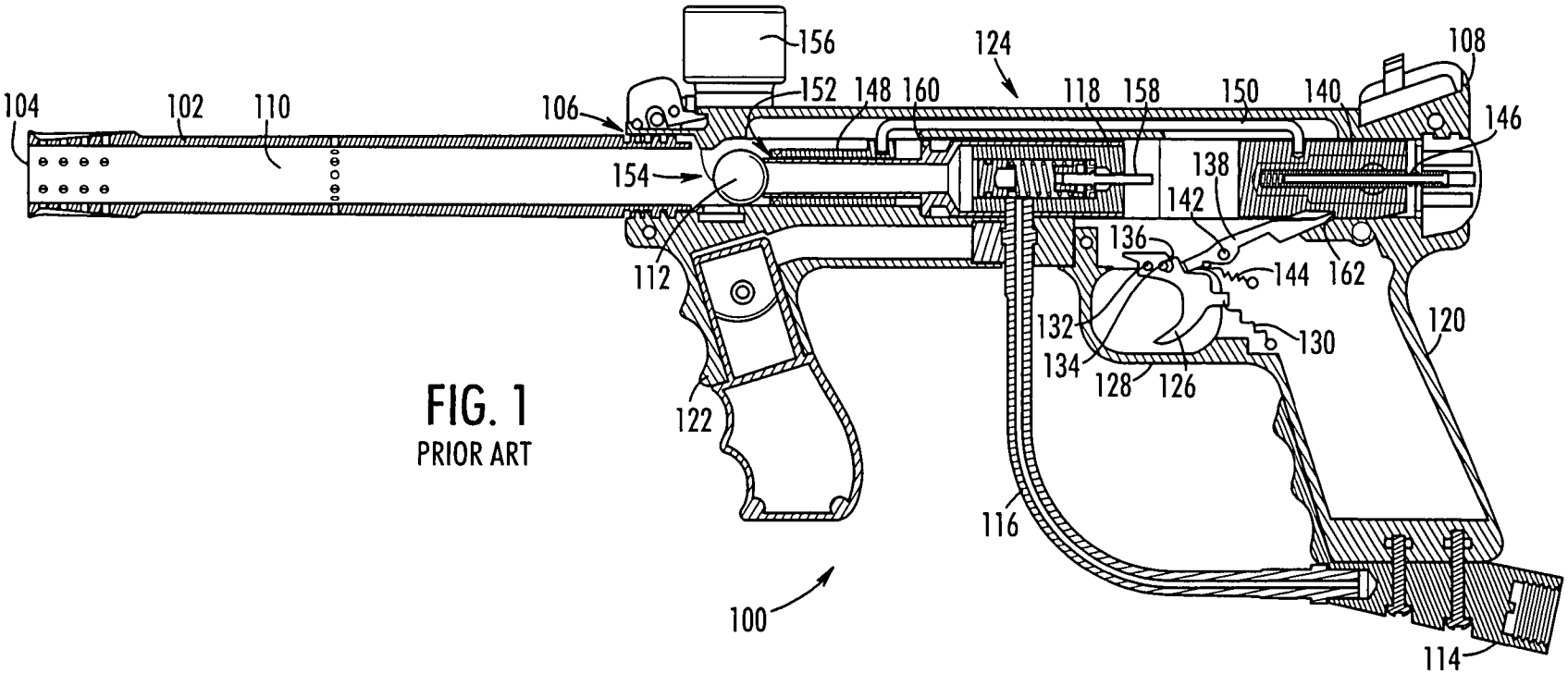
FIG. 1 PRIOR ART
FIG. 1 is a side cross-sectional view of an example of a prior art compressed gas gun in the cocked position that may be improved according to the present invention.

Corresponding reference characters indicate corresponding parts throughout the several views. The components in the Figures are not necessarily to scale, emphasis instead being placed upon illustrating the principles of the invention. The exemplification set out herein illustrates embodiments of the invention, and such exemplification is not to be construed as limiting the scope of the invention in any manner.

DETAILED DESCRIPTION OF THE DRAWINGS

Figure 2:
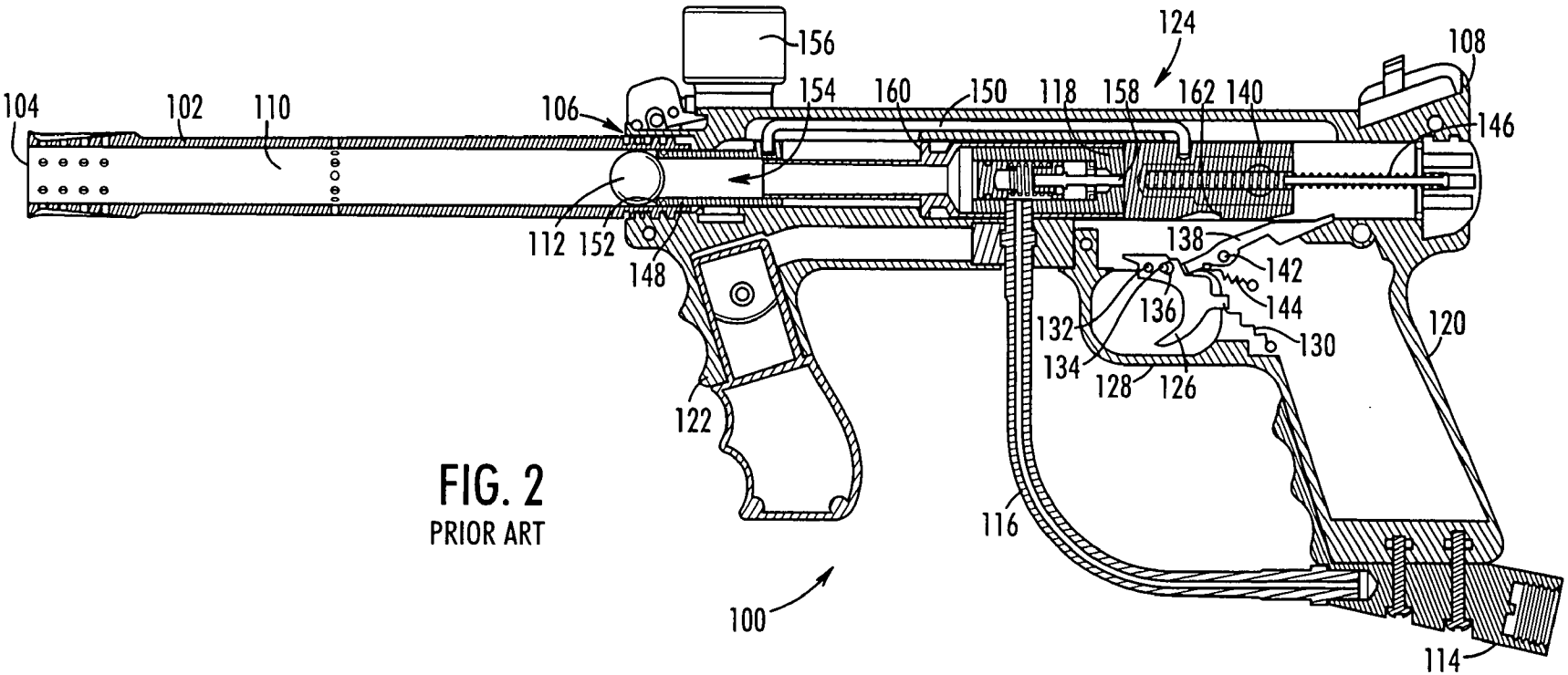
FIG. 2 PRIOR ART
FIG. 2 is the prior art gun of FIG. 1 in the discharge position.

FIGS. 1 and 2 illustrate an example gun 100 of the prior art. Although these figures show a typical paintball marker for purposes of example, it should be appreciated that the present invention could be implemented in other compressed or combustible gas-powered launchers. Moreover, the invention could be implemented in a manual, semi-automatic, or automatic weapon, even though a semi-automatic weapon is shown for purposes of illustration.

As shown, the gun 100 includes a barrel 102 with a muzzle end 104 and a breech end 106. The breech end 106 of the barrel 102 may attach to the receiver 108, such as by screwing the breech end 106 into the receiver 108. By way of other examples, the barrel 102 may attach to the receiver 108 with an interference fit, frictional fit, or unitary formation. The barrel 102 includes a bore 110 dimensioned to receive a frangible projectile 112. When the gun 100 is fired, the projectile 112 passes through the bore 110 in the barrel 102 and exits through the muzzle end 104.

The gun 100 includes a compressed gas inlet 114 adapted to be in fluid communication with a supply of compressed gas (not shown), such as carbon dioxide or nitrogen. As shown, compressed gas inlet 114 is formed near the bottom of the gun 100. It should be appreciated, however, that compressed gas inlet 114 may be located anywhere on the gun, so as to provide the gun with a supply of compressed gas. In the example shown, a conduit 116 allows flow between the compressed gas inlet 114 and a valve assembly 118. It should be appreciated that the invention could be implemented in a gun without a conduit. For example, compressed gas inlet 114 may be formed in the receiver 108 adjacent to the valve assembly 118. As previously discussed, the present invention may also be implemented in a combustible gas gun. The compressed gas gun shown in FIGS. 1 and 2 is provided for example purposes only, but does not limit the type of gun in which the present invention could be implemented.

As shown, the gun 100 includes a grip 120 that is dimensioned for a user to grasp. In the example shown, the gun 100 includes an optional grip 122 that a user may grasp with his other hand to steady the gun 100. By way of another example, the gun may be formed without a grip. For example, the gun 100 may be shaped like a rifle in which the user holds the gun via the receiver and butt stock.

The gun 100 has a trigger assembly with a trigger 126 for actuation by the user to fire the gun 100. In the example shown, the trigger 126 is surrounded by a trigger guard 128. The trigger may move under the bias of a spring 130 and pivots about pivot pin 132. A pin 134 and an elongated aperture 136 may limit the range of movement for the trigger 126. Other trigger arrangements may also be suitable. A sear is interposed between the trigger 126 and a rear bolt 140. In this example, the sear 138 is disposed on pivot pin 142 and is biased by spring 144 toward engagement of the rear bolt 140. When the gun 100 is in the cocked position, actuation of the trigger 126 releases the rear bolt 140 from sear 138. The "cocked position" refers a position of the firing mechanism 124 that is ready for firing. In the example shown, the gun 100 is in the cocked position when the rear bolt 140 is in a rearward position in which the sear 138 prevents forward movement of the rear bolt 140. The "discharge position" refers to the position of the firing mechanism when the projectile is propelled out of the gun 100. In the example shown, discharge position is caused by the release of the rear bolt 140 by the sear 138 due to user actuation of the trigger 126, as shown in FIG. 2. It should be appreciated that other trigger assemblies, both mechanical and electrical, may be suitable to selectively fire the gun and are contemplated herein.

In the example shown in FIGS. 1-2, the firing mechanism 124 includes a rear bolt 140 that moves under the bias of drive spring 146 upon actuation of the trigger 126. The rear bolt 140 is connected to a front bolt 148 via a linkage arm 150. This causes concomitant movement of the front bolt 148 with the movement of the rear bolt 140. The front bolt 148 includes a projectile engagement end 152 adjacent to the breech 154 of the gun 100. The projectile engagement end 152 of the front bolt 148 is adapted to push a projectile 112 from the breech 154 into the breech end 106 of the barrel 102. During each cycle of the gun 100, another projectile 112 is typically loaded into the breech 154 using a projectile feeder 156. Typically, the projectile feeder 156 may be connected to a hopper or other container for holding a plurality of projectiles 112. In other examples, the gun 100 may include an integral magazine for feeding the projectiles into the breech 154. The bias of drive spring 146 on rear bolt 140 causes rear bolt 140 to depress an impact pin 158 on the valve assembly 118, which causes the valve assembly 118 to release a quantity of compressed gas. Valve assembly 118 may be configured to release a portion of compressed gas through a funnel 160, thereby causing a projectile 112 to be propelled out muzzle end 104 of the barrel 102. Another quantity of compressed gas may be released on the side of valve assembly 118 in which the rear bolt 140 is disposed, which will recoil rear bolt 140 to the cocked position.

Operation of the firing mechanism 124 shown in FIGS. 1 and 2 will now be explained. In the cocked position (FIG. 1) a ledge 162 on the rear bolt 140 engages an end of the sear 138 to prevent forward movement of the rear bolt 140. A projectile 112 is in the breech 154 of the gun 100, adjacent to the projectile engagement end 152 of the front bolt 148. When the user actuates the trigger 126, this pivots the sear 138 to disengage the ledge 162 of the rear bolt 140. The drive spring 146 urges the rear bolt forward until the rear bolt 140 impacts the valve assembly 118. Due to the linkage arm 150, the movement of the rear bolt 140 moves the front bolt 148 forward to engage the projectile 112 which pushes the projectile 112 out of the breech 154 and into the breech end 106 of the barrel 102. The valve assembly 118 will open due to the impact of the rear bolt 140 to allow flow of the compressed gas through the funnel 160 to propel the projectile 112 out of the barrel 102. At the same time, the valve assembly will allow flow to recoil the rear bolt 140 into the cocked position. If the projectile 112 is partially inserted into the breech 154 during this firing motion, however, the front bolt 148 tends to shear or rupture the projectile 112, which fouls the breech 154 and the barrel 102 of the gun 100.

FIGS. 3-6 illustrate a firing mechanism 300 that prevents shearing or rupturing of the projectile 112 during firing. This firing mechanism 300 would replace the firing mechanism 124 shown in FIGS. 1 and 2. The conventional elements of the gun 100 shown in FIGS. 1 and 2 will be indicated by the same reference numbers and augment FIGS. 3-6.

Figure 4:
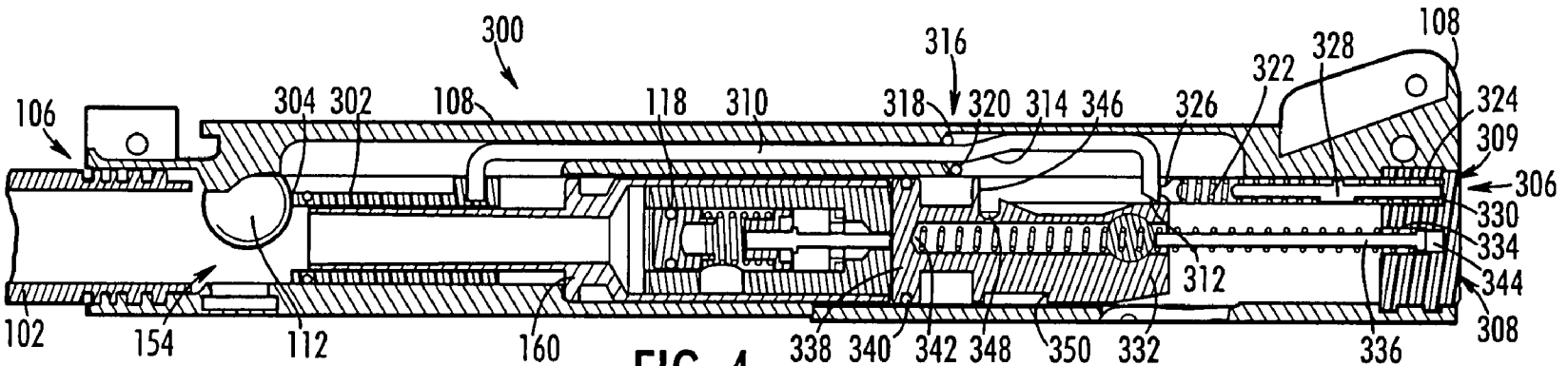
FIG. 4 is a side cross-sectional view of the firing mechanism of FIG. 3 where a projectile is jammed in the breech of the gun during firing.
Figure 5:
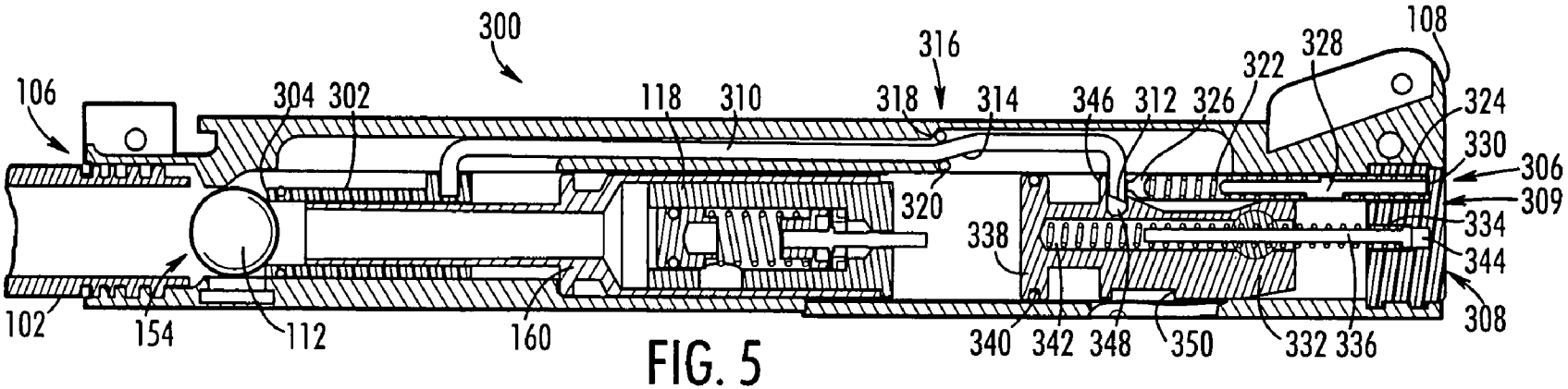
FIG. 5 is a side cross-sectional view of the firing mechanism of FIG. 3 showing initial engagement of the linkage arm with the rear bolt.
Figure 6:
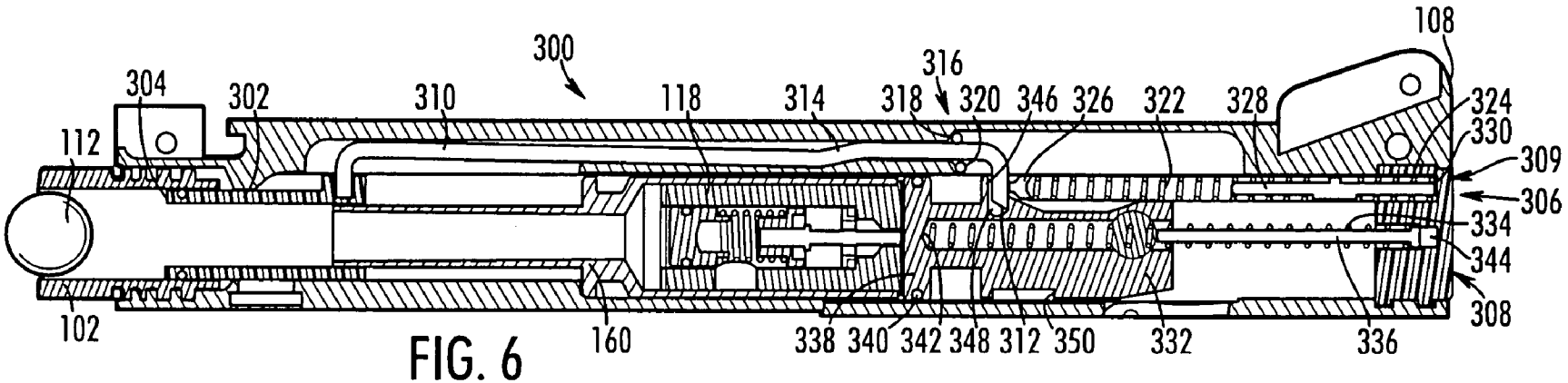
FIG. 6 is a side cross-sectional view of the firing mechanism of FIG. 3 in the discharge position.

In the example shown in FIGS. 3-6, the firing mechanism 300 includes a front bolt 302 that is adjacent to the breech 154 of the gun 100. The front bolt 302 is movable between a cocked position (FIG. 3) and a discharge position (FIG. 6). In the cocked position, the front bolt 302 is positioned adjacent to a projectile 112 in the breech 154 of the gun 100. When the gun 100 is fired, the front bolt 302 moves forward into the breech 154 to engage the projectile 112 and push the projectile 112 into the barrel 102 of the gun 100. The front bolt 302 includes a projectile engaging portion 304 that is configured to engage the projectile 112 in this manner. In the example shown in FIGS. 3-6, the front bolt 302 is driven by a first drive mechanism 306 and a second drive mechanism 308 via a linkage arm 310. In this example, a portion of the first drive mechanism 306 and the second drive mechanism 308 are received in an end cap 309. The end cap 309 includes apertures 330 and 344 dimensioned to receive the first drive mechanism 306 and the second drive mechanism 308, respectively. The apertures 330 and 344 are spaced apart to correspond with the spacing of the first drive mechanism 306 and the second drive mechanism 308. It should be appreciated that the end cap 309 may be constructed as a unitary portion of the receiver. Embodiments are also contemplated in which the end cap 309 may be an adaptor for connecting another device to the gun 100. For example, the adaptor may include slots to receive the first drive mechanism 306 and the second drive mechanism 308.

As described in more detail below, the first drive mechanism 306 independently drives the front bolt 302 during a portion of the travel from the cocked position to the discharge position. It should be appreciated that the particular manner in which the front bolt is driven in FIGS. 3-6 is provided for purposes of example only. Other embodiments are contemplated for driving front bolt with a first force for a portion of the travel and a second force during another portion of the travel. For example, first drive mechanism and/or second drive mechanism may be pneumatically, hydraulically or electrically-controlled. By way of another example, a single drive mechanism may be configured to drive the front bolt with varying force during the front bolt's travel.

As shown, the linkage arm 310 has a first end connected to the front bolt 302 and a second end with a tip 312. Embodiments are also contemplated in which the linkage arm 310 is unitary with the front bolt 302. In some embodiments, the linkage arm 310 may not be directly connected to the front bolt 302. For example, an intervening structure may connect linkage arm 310 to front bolt 302. The linkage arm 310 may include a curved portion 314 that engages a guide 316 to control lateral movement of the tip 312. As shown, the linkage arm 310 is journaled between a first member 318 and a second member 320 of the guide 316. In other embodiments, the guide 316 may control the lateral movement of the tip 312 using other mechanical or electrical structures. For example, the guide may be a magnet that repels a magnet on the linkage arm 310.

In the example shown, the first drive mechanism 306 engages the linkage arm 310 to drive the front bolt 302. In other embodiments, the first drive mechanism 306 may directly engage the front bolt 302. As shown, the front drive mechanism 306 comprises a first spring 322 and a second spring 324 (as best seen in FIG. 6) that urge the linkage arm 310 toward the breech 154, which drives the front bolt 302 toward the breech 154. The first spring 322 is held between a retainer cup 326 and a pin 328. Second spring 324 is held between the pin 328 and an aperture 330 in the end cap 309. Embodiments are also contemplated in which first drive mechanism 306 includes a single spring. Other mechanisms for driving front bolt 302 are within the scope of this invention. For example, first drive 306 mechanism may use hydraulics or an electrically-controlled mechanism. Embodiments are also contemplated in which the tension of the first spring 322 and/or the second spring 324 may be controlled. For example, an adjustment anchor (not shown) may be disposed in the aperture 330. The adjustment anchor may be movable with respect to the second spring 324 to increase or reduce the compression of the second spring 324, which will increase or reduce the force with which the first drive mechanism 306 drives the front bolt 302.

The first drive mechanism 306 drives the front bolt 302 with a force that is less than a projectile rupturing force. By "projectile rupturing force," it is meant a force that is less than that required to rupture or shear a frangible projectile. The projectile rupturing force may depend on the type of projectile intended for use with the gun. For example, the projectile rupturing force of a projectile with a plastic shell may be greater than that of a projectile with a gelatinous shell. When the first drive mechanism 306 solely drives the front bolt 302, the front bolt 302 will not shear or rupture a jammed or improperly seated projectile 112.

The second drive mechanism 308 may selectively drive the front bolt 302. As shown, the second drive mechanism 308 comprises a rear bolt 332, drive spring 334, and drive pin 336. The rear bolt 332 includes a head portion 338 that is surrounded by a seal 340, such as an o-ring, to seal the chamber between the head portion 338 and the valve assembly 118. This will allow pressure within the chamber to recoil the rear bolt 332 after head portion 338 impacts the valve assembly 118.

The rear bolt 332 includes a rear portion with a groove 342 that is dimensioned to receive the drive spring 334 and the drive pin 338. A portion of the drive spring 334 and the drive pin 336 are disposed within the groove 342, while a rearward portion of the drive spring 334 and drive pin 336 are disposed in an aperture 344 in the rear portion of the receiver 108. As discussed previously with respect to the first drive mechanism 306, an adjustment anchor (not shown) may be disposed in the aperture 344. The rear bolt 332 includes a ridge 346 that acts as a stop to prevent lateral movement of the linkage arm 310 when the gun 100 is in the cocked position. The rear bolt 332 also includes a recess 348 that is dimensioned to receive the tip 312 of the linkage arm 310. A ledge 350 is formed on the rear bolt 332 to engage the sear 138, which prevents forward movement of the rear bolt 332 when the gun 100 is in the cocked position.

Figure 3:
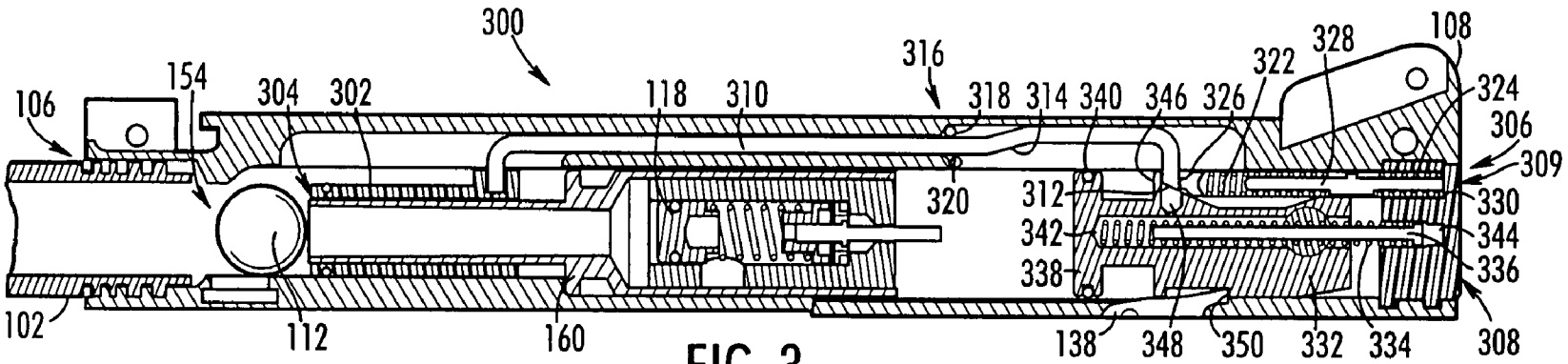
FIG. 3 is a side cross-sectional view of a firing mechanism in the cocked position in accordance with one aspect of the present invention.

Referring now to FIG. 3, the firing mechanism 300 is in the cocked position. In this position, the engagement of the sear 138 with the ledge 350 on the rear bolt 332 prevents forward movement of the rear bolt 332. The ridge 346 on the rear bolt 332 prevents forward movement of the linkage arm 310, thereby preventing forward movement of the front bolt 302.

FIG. 4 illustrates the operation of the firing mechanism 300 in the event that a projectile 112 is jammed or partially inserted in the breech 154. When the sear 138 releases the rear bolt 332, the drive spring 334 moves the rear bolt 332 to impact the valve assembly 118. The movement of the rear bolt 332 moves the ridge 346 to allow movement of the linkage arm 310, which also moves the front bolt 302. The projectile 112 prevents continued movement of the front bolt. However, the tip 312 does not engage the recess 348 in the rear bolt 332 because the linkage arm 310 does not travel far enough to engage the guide 314. In some cases, the tip 312 may be sloped to slide on top of rear bolt 332 without engagement. Since the tip 312 of the linkage arm 310 does not engage the recess 348 in the rear bolt 332, the drive spring 334 does not drive the front bolt 302. Instead, the first drive mechanism 306 independently drives the front bolt 302 via the linkage arm 310. Since the force with which the first drive mechanism 306 drives the front bolt is less than a projectile rupturing force, the jammed projectile 112 prevents forward movement of the front bolt 302, without rupturing or shearing the projectile 112.

When the rear bolt 332 impacts the valve assembly 118, the valve assembly 118 opens to allow flow of compressed gas through the funnel 160. Since the front bolt 302 engages the projectile 112, the projectile is not propelled out of the barrel 102. However, the release of compressed gas on the opposing side of the valve assembly 118 recoils the rear bolt 332 back to the cocked position.

FIG. 5 illustrates the operation of the firing mechanism 300 as the tip 312 of the linkage arm 310 engages the recess 348 in the rear bolt 332. Since the projectile 112 is properly seated in the breech 154, the front bolt 302 may push the projectile 112 out of the breech 154. This allows the curved portion 314 of the linkage arm 310 to engage the guide 316. Due to the slope of the curved portion 314, the guide 316 laterally moves the tip 312 into the recess 348 of the rear bolt 332. Once the tip 312 engages the recess 348, the drive spring 334 also drives the front bolt 302. Accordingly, once the tip 312 of the linkage arm 310 engages the recess 348 of the rear bolt 332, both the first drive mechanism 306 and the second drive mechanism 308 drive the front bolt 302. This prevents a problem associated with front bolts that are spring-loaded solely with a spring force that is less than a projectile rupturing force in which pressure from firing may move front bolt rearward and thereby allow gas to flow into the projectile feed port. Since both the first drive mechanism 306 and the rear drive mechanism 308 drive the front bolt 302, the firing mechanism 300 is not susceptible to this problem.

FIG. 6 shows the firing mechanism 300 as the projectile 112 is propelled out the barrel 102 of the gun 100. As can be seen, the tip 312 of the linkage arm 310 still engages the recess 348 in the rear bolt due to the guide 316. Once the head portion 338 of the rear bolt 332 impacts the valve assembly 118, compressed gas flows through the funnel 160 to propel the projectile 112 out of the barrel 102. At the same time, the valve assembly allows flow of gas to recoil the rear bolt 332 back to the cocked position. As the rear bolt travels rearward to the cocked position, the linkage arm 310 travels along the guide 316. When the curved portion 314 of the linkage arm 310 passes through the guide 316, the tip 312 disengages from the recess 348 in the rear bolt 332. However, the ridge 346 engages the linkage arm 310 so that the linkage arm 310 travels rearward with the rear bolt 332, which repositions the front bolt 332 out of the breech 154 so that another projectile 112 may be loaded into the breech 154 of the gun 100. The firing mechanism 300 is then in the cocked position and ready for the user to actuate the trigger 126 to fire another projectile 112. It should be appreciated that rear bolt 332 may be manually moved to the cocked position.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A paintball gun comprising:

a barrel dimensioned to receive a frangible projectile;

a breech dimensioned to receive the frangible projectile, wherein said breech is proximate to said barrel;

a valve assembly operative to selectively allow flow between a supply of compressed gas and said breech;

a bolt movable between a first position and a second position, wherein a crossover point is positioned between said first position and said second position, wherein said bolt is configured to engage said frangible projectile as said bolt moves toward said second position;

a first drive mechanism operative to drive said bolt toward said second position;

a linkage arm operatively connected to said bolt;

a second drive mechanism capable of being engaged by said linkage arm, wherein said second drive mechanism drives said bolt toward said second position when said linkage arm engages said second drive mechanism;

wherein said first drive mechanism drives said bolt independent of said second drive mechanism between said first position and said crossover point;

wherein said linkage arm engages said second drive mechanism when said bolt travels between said crossover point and said second position so said second drive mechanism and said first drive mechanism drive said bolt in unison between said crossover point and said second position.

2. The paintball gun of claim 1, wherein said first drive mechanism drives said bolt with a first force, wherein said second drive mechanism drives said bolt with a second force when said linkage arm engages said second drive mechanism, and wherein said first force is less than said second force.

3. The paintball gun of claim 2, wherein said first force is less than a projectile rupturing force.

4. The paintball gun of claim 1, wherein said linkage arm moves concomitant with said bolt.

5. The paintball gun of claim 1, wherein said second drive mechanism includes a recess dimensioned to receive a portion of said linkage arm.

6. The paintball gun of claim 5, wherein said linkage arm includes a tip portion capable of engaging said recess.

7. The paintball gun of claim 6, wherein said tip portion engages said recess when said bolt travels a predetermined distance from said first position to said second position.

8. The paintball gun of claim 7, further comprising a guide operative to control lateral movement of said tip portion.

9. The paintball gun of claim 8, wherein at least a portion of said linkage arm passes through said guide.

10. The paintball gun of claim 8, wherein said linkage arm includes a curved portion, wherein said tip moves laterally to engage said recess when said curved portion engages said guide.

11. The paintball gun of claim 10, wherein said linkage arm includes a first end connected to said bolt and a second end with said tip.

12. The paintball gun of claim 11, wherein said second end of said linkage arm is operatively connected to said first drive mechanism.

13. The paintball gun of claim 11, wherein said second drive mechanism includes a ridge adapted to engage said second end of said linkage arm.

14. The paintball gun of claim 11, wherein said curved portion is located between said first end and said second end.

15. The paintball gun of claim 1, wherein said first drive mechanism includes at least one compression spring and wherein said second drive mechanism includes at least one compression spring.

16. The paintball gun of claim 15, wherein said first drive mechanism includes at least two compression springs.

17. The paintball gun of claim 1, wherein said bolt and said second drive mechanism move along a common axis.

18. The paintball gun of claim 1, wherein said valve assembly is positioned between said bolt and said second drive mechanism.

19. The paintball gun of claim 18, wherein said valve assembly is axially aligned with said bolt and said second drive mechanism.

20. A paintball gun comprising:

a barrel dimensioned to receive a frangible projectile;

a breech dimensioned to receive the frangible projectile, wherein said breech is proximate to said barrel;

a valve assembly operative to selectively allow flow between a supply of compressed gas and said breech;

a bolt movable between a first position and a second position, said bolt configured to engage said frangible projectile as said bolt moves from said first position to said second position, wherein a crossover point is positioned between said first position and said second position;

first drive means for driving said bolt toward said second position;

second drive means for driving said bolt toward said second position, wherein said first drive means drives said bolt independent of said second drive means between said first position and said crossover point; and wherein said second drive means and said first drive means drive said bolt in unison between said crossover point and said second position.

21. The paintball gun of claim 20, wherein said first drive means drives said bolt with less force than said second drive means.

22. The paintball gun of claim 21, wherein said first drive means drives said bolt with a force less than a projectile rupturing force.

23. A gun with an anti jam firing mechanism, said gun comprising:

a barrel dimensioned to receive a frangible projectile;

a breech dimensioned to receive the frangible projectile, wherein said breech is proximate to said barrel;

a valve assembly operative to selectively allow flow between a supply of compressed gas and said breech;

a front bolt movable between a first position and a second position, said front bolt operative to push the frangible projectile out of said breech as said front bolt moves from said first position to said second position, wherein a crossover point is positioned between said first position and said second position;

a first drive mechanism operative to drive said front bolt toward said second position;

a rear bolt moveable between a third position and a fourth position, said rear bolt operative to actuate said valve assembly when said rear bolt moves to said fourth position;

a drive spring urging said rear bolt to said fourth position;

a linkage arm operatively connected to said front bolt, said linkage arm capable of engaging said rear bolt;

wherein said drive spring urges said front bolt toward said second position when said linkage arm engages said rear bolt;

wherein said linkage arm engages said rear bolt when said front bolt travels a predetermined distance from said first position to said second position;

wherein said first drive mechanism drives said bolt independent of said drive spring between said first position and said crossover point; and wherein said drive spring and said first drive mechanism drive said bolt in unison between said crossover point and said second position.

24. The gun of claim 23, wherein said front bolt moves concomitant with said rear bolt when said linkage arm engages said rear bolt.

25. The gun of claim 23, wherein said first drive mechanism drives said front bolt with a first force, wherein said drive spring drives said front bolt with a second force when said linkage arm engages said rear bolt, and wherein said first force is less than said second force.

26. The gun of claim 25, wherein said first force is less than a projectile rupturing force.

27. The gun of claim 23, wherein said linkage arm moves concomitant with said front bolt.

28. The gun of claim 23, wherein said rear bolt includes a recess dimensioned to receive a portion of said linkage arm.

29. The gun of claim 28, wherein said linkage arm includes a tip portion capable of engaging said recess.

30. The gun of claim 29, wherein said tip portion engages said recess when said front bolt travels a predetermined distance from said first position to said second position.

31. The gun of claim 30, further comprising a guide operative to control lateral movement of said tip portion.

32. The gun of claim 31, wherein at least a portion of said linkage arm passes through said guide.

33. The gun of claim 31, wherein said linkage arm includes a curved portion and wherein said tip moves laterally to engage said recess when said curved portion engages said guide.

34. The gun of claim 33, wherein said linkage arm includes a first end connected to said front bolt and a second end with said tip.

35. The gun of claim 34, wherein said second end of said linkage arm is operatively connected to said first drive mechanism.

36. The gun of claim 34, wherein said rear bolt includes a ridge adapted to engage said second end of said linkage arm.

37. The gun of claim 34, wherein said curved portion is located between said first end and said second end.

38. The gun of claim 23, wherein said first drive mechanism includes at least one compression spring and wherein said drive spring is a compression spring.

39. The gun of claim 38, wherein said first drive mechanism includes at least two compression springs.

40. The gun of claim 23, wherein said front bolt and said rear bolt move along a common axis.

41. The gun of claim 23, wherein said valve assembly is positioned between said front bolt and said rear bolt.

42. The gun of claim 41, wherein said valve assembly is axially aligned with said front bolt and said rear bolt.

43. A paintball gun comprising:

a barrel dimensioned to receive a frangible projectile;

a breech dimensioned to receive said frangible projectile, wherein said breech is proximate to said barrel;

a valve assembly operative to selectively allow flow between a supply of compressed gas and said breech;

a bolt movable between a first position and a second position, wherein a crossover point is positioned between said first position and said second position, wherein said bolt is configured to engage said frangible projectile as said bolt moves toward said second position;

a first drive mechanism operative to drive said bolt toward said second position with a first force;

a second drive mechanism operative to drive said bolt toward said second position with a second force;

wherein said first drive mechanism drives said bolt independent of said second drive mechanism between said first position and said crossover point; and wherein said first drive mechanism and said second drive mechanism drive said bolt in unison between said crossover point and said second position.

44. The paintball gun of claim 43, wherein said first force is less than a projectile rupturing force.

45. The paintball gun of claim 43, wherein a combination of said first force and said second force is more than a projectile rupturing force.

46. The paintball gun of claim 43, wherein said bolt and said first drive mechanism move along a common axis.

47. The paintball gun of claim 43, wherein said first drive mechanism includes at least one spring.

48. The paintball gun of claim 43, wherein said second drive mechanism includes at least one string.

49. The paintball gun of claim 43, wherein said second drive mechanism is movable between a third position and a fourth position, wherein said second drive mechanism is configured to actuate said valve assembly when moving toward said fourth position.

50. An anti-jam firing mechanism, said firing mechanism comprising:

a front bolt movable between a first position and a second position;

a first drive mechanism operative to drive said front bolt toward said second position;

a linkage arm operatively connected to said front bolt;

a second drive mechanism capable of being engaged by said linkage arm, wherein said second drive mechanism drives said front bolt toward said second position when said linkage arm engages said second drive mechanism;

wherein said linkage arm engages said second drive mechanism when said front bolt travels a predetermined distance from said first position to said second position;

wherein said second drive mechanism includes a recess dimensioned to receive a portion of said linkage arm;

wherein said linkage arm includes a tip portion capable of engaging said recess;

wherein said tip portion engages said recess when said front bolt travels a predetermined distance from said first position to said second position;

a guide operative to control lateral movement of said tip portion, wherein at least a portion of said linkage arm passes through said guide; and wherein said linkage arm includes a curved portion, wherein said tip moves laterally to engage said recess when said curved portion engages said guide.

51. The firing mechanism of claim 50, wherein said linkage arm includes a first end connected to said front bolt and a second end with said tip.

52. The firing mechanism of claim 51, wherein said second end of said linkage arm is operatively connected to said first drive mechanism.

53. The firing mechanism of claim 51, wherein said second drive mechanism includes a ridge adapted to engage said second end of said linkage arm.

54. The firing mechanism of claim 51, wherein said curved portion is located between said first end and said second end.

55. A gun with an anti-jam firing mechanism, said gun comprising:

a barrel dimensioned to receive a frangible projectile;

a breech dimensioned to receive the frangible projectile, wherein said breech is proximate to said barrel;

a valve assembly operative to selectively allow flow between a supply of compressed gas and said breech;

a front bolt movable between a first position and a second position, said front bolt operative to push the frangible projectile out of said breech as said front bolt moves from said first position to said second position;

a first drive mechanism operative to drive said front bolt toward said second position;

a rear bolt moveable between a third position and a fourth position, said rear bolt operative to actuate said valve assembly when said rear bolt moves to said fourth position;

a drive spring urging said rear bolt to said fourth position;

a linkage arm operatively connected to said front bolt, said linkage arm capable of engaging said rear bolt;

wherein said drive spring urges said front bolt toward said second position when said linkage arm engages said rear bolt;

wherein said linkage arm engages said rear bolt when said front bolt travels a predetermined distance from said first position to said second position;

wherein said rear bolt includes a recess dimensioned to receive a portion of said linkage arm;

wherein said linkage arm includes a tip portion capable of engaging said recess, wherein said tip portion engages said recess when said front bolt travels a predetermined distance from said first position to said second position; and a guide operative to control lateral movement of said tip portion, wherein said linkage arm includes a curved portion and wherein said tip moves laterally to engage said recess when said curved portion engages said guide.

56. The gun of claim 55, wherein said linkage arm includes a first end connected to said front bolt and a second end with said tip.

57. The gun of claim 56, wherein said second end of said linkage arm is operatively connected to said first drive mechanism.

58. The gun of claim 56, wherein said rear bolt includes a ridge adapted to engage said second end of said linkage arm.

59. The gun of claim 56, wherein said curved portion is located between said first end and said second end.

* * * * *